United States Patent [19]

Pasic

[11] 4,387,631

[45] Jun. 14, 1983

[54] STRAP TENSIONING APPARATUS

[75] Inventor: James A. Pasic, Montesano, Wash.

[73] Assignee: Ovalstrapping, Inc., Hoquiam, Wash.

[21] Appl. No.: 262,301

[22] Filed: May 11, 1981

[51] Int. Cl.[3] ..... B65B 13/22

[52] U.S. Cl. ..... 100/32

[58] Field of Search ..... 100/26, 29, 32

[56] References Cited

U.S. PATENT DOCUMENTS 3,057,289 10/1962 Luthi ..... 100/32 X 3,157,109 11/1964 Flanigan et al. ..... 100/32 X 3,183,824 5/1965 Cook ..... 100/32 X 4,120,239 10/1978 Pasic et al. ..... 100/32 X

*Primary Examiner*—Billy J. Wilhite

*Attorney, Agent, or Firm*—Seed, Berry, Vernon & Baynham

[57] ABSTRACT

A rough and final pull back tension are applied by moving the strap laterally of its path between a fixed strap end and a releasably anchored strap supply end, with the releasably anchored end being held by spaced pins biased together to obtain the rough tension and a greater final tension.

4 Claims, 5 Drawing Figures

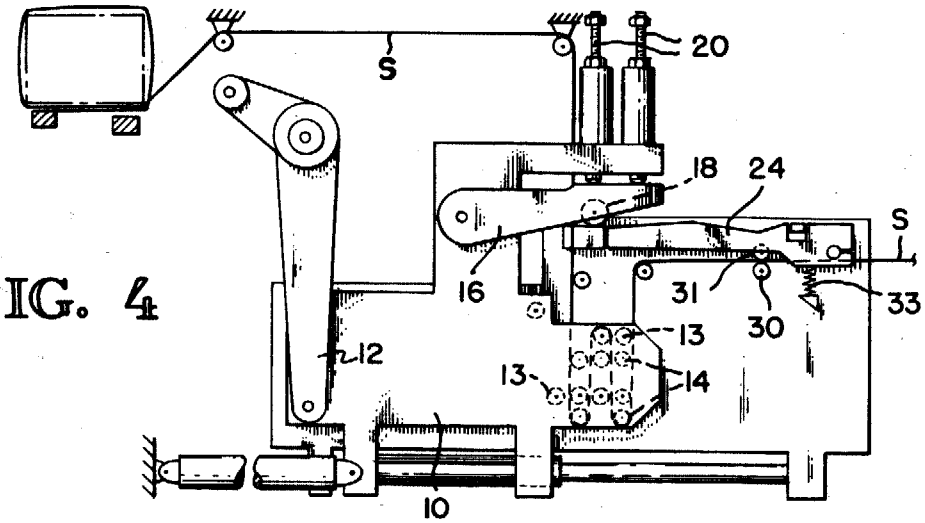
FIG. 4
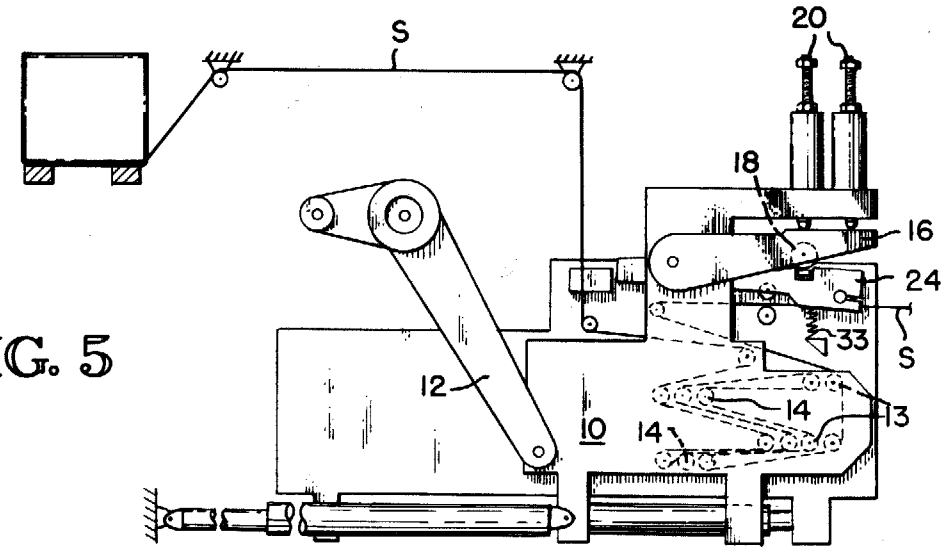
FIG. 5
FIG. 3
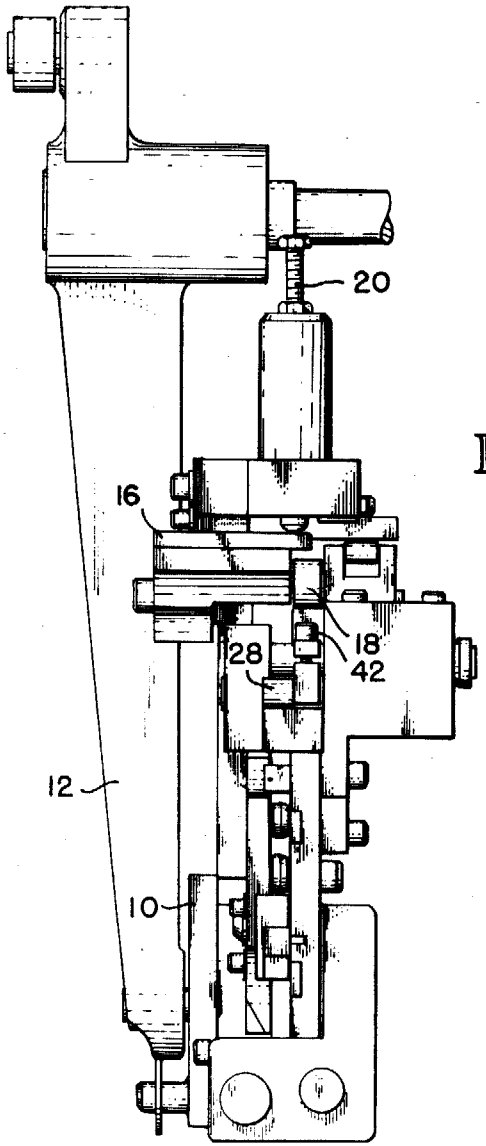

STRAP TENSIONING APPARATUS

TECHNICAL FIELD

This invention pertains to strapping or banding apparatus for placing a flexible strap or band around an object, and, in particular, to apparatus for tensioning the strap tightly around the object prior to crimping or sealing the strap on the object.

BACKGROUND ART

U.S. Pat. No. 4,120,239 shows a strapping machine in which the strap is tensioned around the object by moving the strap laterally of its feed path and sequentially gripping the supply end of the strap, first to produce a low tension when the strap is moved laterally so as to remove the slack of the loop formed around the object, and then, finally, to grip the supply end with a desired force to produce a final tension so as to draw the strap tightly around the object. The apparatus of this subject application is an improvement on the strap tensioning apparatus of the patent.

DISCLOSURE OF THE INVENTION

It is an object of this invention to provide an improved strap or band tensioning apparatus for a strapping machine, particularly a strapping machine of the type shown in U.S. Pat. No. 4,120,239.

Basically, this invention uses the same broad technique of strap tensioning as in the patent but applies the gripping pressure on the supply end of the strap at the same location on the strap during both the first rough tensioning and the second final tensioning. As a result, while using the same concept as the patent, the apparatus is great simplified, making the strapping sequence more reliable and making the apparatus less expensive to manufacture.

BRIEF DESCRIPTION OF THE DRAWINGS

FIG. 3 is an end elevation of the apparatus shown in FIG. 1.

FIG. 4 is an overall schematic illustrating the strap during the initial tensioning.

FIG. 5 is an operational schematic showing the strap during final tensioning.

BEST MODE FOR CARRYING OUT THE INVENTION

Figures 1, 2:
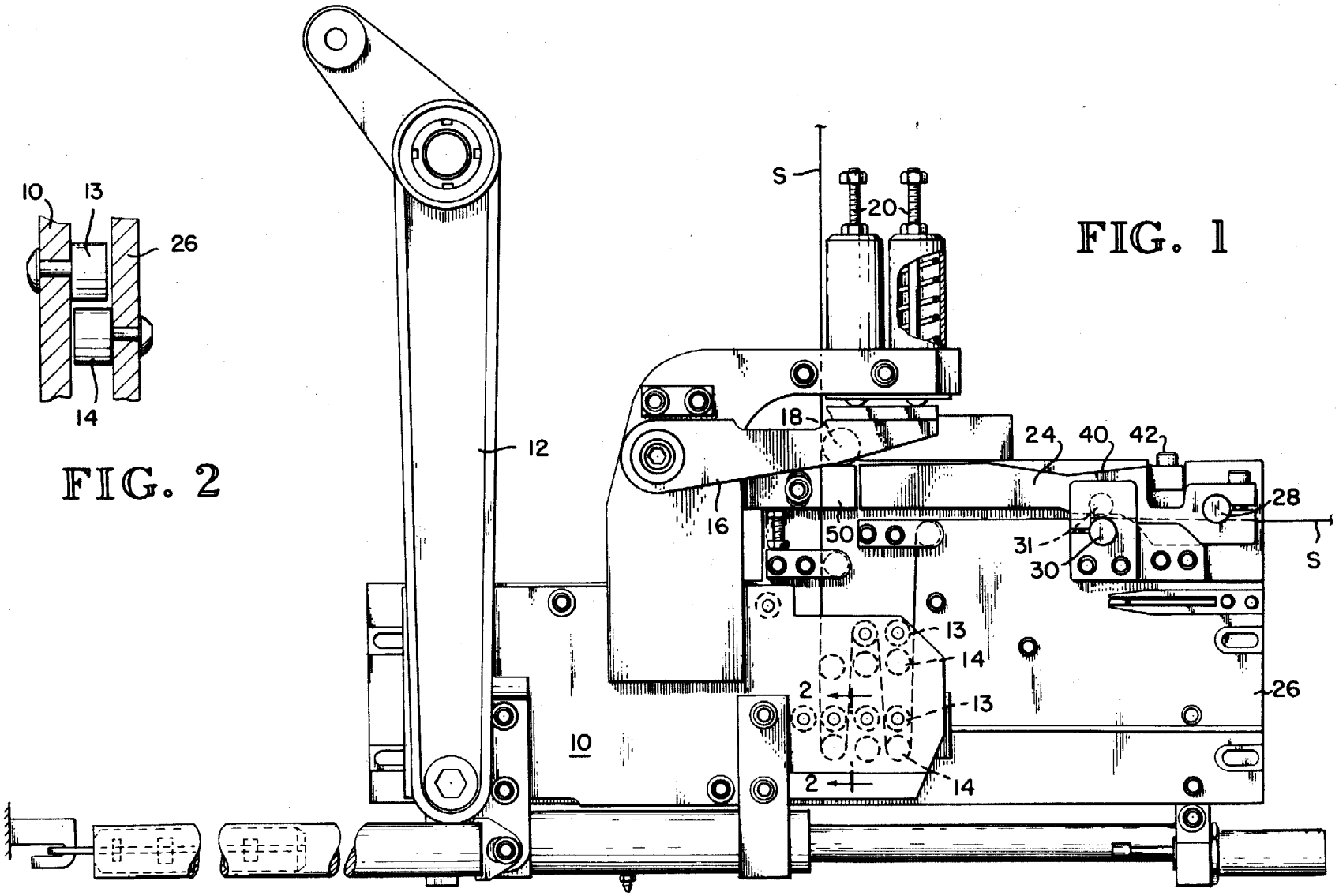
FIG. 1 is a fragmentary side elevation of the strapping apparatus of a strapping machine of the type shown in U.S. Pat. No. 4,120,239.
FIG. 2 is a detailed section along the line 2—2 of FIG. 1.

The strapping apparatus forms a part of the strapping machine shown in U.S. Pat. No. 4,120,239, and the details of that machine are not critical to the understanding of this invention. The description of the patent, however, is incorporated herein by reference thereto. As is understood, the strapping apparatus has a carrier plate 10 that is reciprocated by a tension arm 12 which is operated from a cam (not shown). The carrier plate carries a plurality of movable rollers 13 which are interposed between a plurality of fixed rollers 14.

Pivotally mounted on the carrier plate 10 is a roller lever 16 having a freely rotatable roller 18 on one end thereof. The lever is urged downwardly or clockwise, as shown in FIG. 1, by a pair of tensioning springs 20. A cam lever 24 is mounted on a stationary frame 26 of the machine and is free to pivot about a post 28. A lower gripping pin 31 is mounted on the cam lever 24. A spring 33 biases the cam lever upwardly so that pin 31 is spaced from pin 30.

The cam lever is provided with a ramp 40. A bar 42 fits in a recess in the cam lever and is fixed to the frame 26.

The details of the strapping apparatus are now best understood from a description of its operation.

Once the track on the strapping apparatus is open and the strap has been positioned around the object, as in FIG. 4, the free end of the strap is gripped and held against movement. The tension arm 12 is then driven counterclockwise to the right, which in turn drives the carrier plate 10 to the right.

The first motion of the carrier plate 10 causes the roller 18 mounted on the roller lever 16 to roll onto the cam lever 24. The springs 20 force the cam lever down, causing it to pinch the strap from the supply S between the tension pins 30 and 31. This anchors the strap so that it will be drawn into the tension unit from the track around the object to be strapped rather than from the accumulator or strap supply. If the object is large, however, strap can be drawn from the accumulator.

The strap is reeved between the sets of rollers 13 and 14 on the frame 26. As a result, as the movable rollers pass the fixed rollers, the strap will be very quickly drawn down onto the object by the movement of the carrier plate. Once the strap is drawn down to the package or object, a tension will be imposed on the strap since the carrier plate is still moving to the right and no additional strap can be drawn from the track and only enough strap to avoid breakage will be drawn from the accumulator.

When the tension in the strap rises to a level determined by the pinch of the tension pins, the strap will be drawn through the pins from the accumulator. As the tension plate nears the end of its stroke, the roller 18 climbs the ramp 40. This compresses the tension control springs 20 and consequently increases the pinch of the pins of the strap. This increased pinch causes the strap to be tightened to its final tension since the lateral movement of the strap can now draw strap from the accumulator only at this final tension.

At the very end of the carrier plate stroke, the roller 18 rides up onto the trip bar 42, thus relieving the force on the cam lever and releasing the pins from the strap. This causes the strap to go slack so that it will not be under tension when it is cut from the seal at the sealing apparatus of the machine. The tension of the strap around the package is retained, however, since both ends of the loop formed around the object are held at the vicinity of the object while it is being sealed, as in FIG. 5.

The carrier plate is then moved to the left until it reaches its home position, at which time the roller 18 moves off the cam lever onto a rigid support block 50. This releases the cam lever, which is then raised by the spring 33, thus separating the pinch pins. This releases the strap so that the feeding cycle for new strap loop can be completed.

The strap can then be cycled, either manually or automatically, and the straping cycle repeated.

While the preferred embodiment of the invention has been illustrated and described, it should be understood that variations will be apparent to one skilled in the art without departing from the principles herein. Accordingly, the invention is not to be limited to the specific embodiment in the drawings.

I claim:

1. In a machine for applying from a strap supply a flexible strap or other binding material having a supply end and an object end through a feed path to form a loop around an object, a strap tensioning mechanism for pulling the strap around the object to remove slack and then tightening the loop around the object as the object end of the strap is held, comprising:

strap gripping means for releasibly gripping the supply end of the strap against longitudinal movement at a holding location as the strap is pulled around the object at a first tension, means for varying the gripping pressure on the strap by said gripping means at said holding location for allowing longitudinal movement of the strap toward the object relative to the gripping means at a desired final tension greater than said first tension, and means for laterally deflecting the strap out of said feed path while the object and supply ends of the strap are held for pulling the strap and tightening the loop around the object at said first tension and then at said greater final tension while the supply end of the strap remains free to move longitudinally from the supply at said final tension.

2. The machine of claim 1, said strap gripping means including a set of opposed strap engaging pins, one on each side of the strap, and means for pressing the pins together at different forces to control said gripping pressure on said strap for obtaining said first and final tensions.

3. The machine of claim 2, said means for pressing said pins together including a roller lever having a movable end, a roller on said movable end of said roller lever, said roller engaging a cam lever coupled to a movable one of said pins, the second of said pins being fixed, first spring means for biasing said roller lever against said cam lever while the strap is pulled at said first tension, and a ramp on said cam lever engageable by said roller for varying the pressing force on said movable pin for obtaining said final tension, and means for moving said roller along said cam lever for pressing the pins together and for removing the roller from said cam lever to release said pins, and including second spring means to bias the pins apart when the roller is removed from said cam lever.

4. In a machine for applying a flexible strap having a supply end and an object end through a feed path to form a loop around an object to be strapped, a strap tensioning mechanism for pulling the strap toward the supply end to tighten the loop around the object, comprising:

means for holding the object end of the strap adjacent the object, means at a single location along said feed path for applying a controlled holding pressure on the supply end of the strap to allow movement of the strap in its longitudinal direction toward the object end of the strap only after a predetermined final tensioning force is reached in the strap, means for pulling the loop tightly around and against the object to reach the final strap tension by moving the strap laterally out of said feed path between said held strap ends.

* * * * *